US006974408B2

(12) United States Patent
Grosse-Wiesmann

(10) Patent No.: US 6,974,408 B2
(45) Date of Patent: Dec. 13, 2005

(54) CENTRIFUGE FOR THE PURIFICATION OF LUBRICATING OIL OF AN INTERNAL-COMBUSTION ENGINE

(75) Inventor: Karl Grosse-Wiesmann, Nottuln (DE)

(73) Assignee: Hengst GmbH & Co. K.G., Muenster (DE)

( * ) Notice: Subject to any disclaimer, the term of this patent is extended or adjusted under 35 U.S.C. 154(b) by 210 days.

(21) Appl. No.: 10/655,110

(22) Filed: Sep. 4, 2003

(65) Prior Publication Data

US 2005/0020428 A1 Jan. 27, 2005

(30) Foreign Application Priority Data

Sep. 4, 2002 (DE) ..... 202 13 786 U

(51) Int. Cl.[7] ..... B04B 9/06; B04B 11/04
(52) U.S. Cl. ..... 494/5; 494/49
(58) Field of Search ..... 494/5, 24, 36, 494/43, 49, 64, 65, 67, 84, 901; 210/168, 171, 232, 360.1, 380.1, 416.5; 184/6.24

(56) References Cited

U.S. PATENT DOCUMENTS 1,720,475 A * 7/1929 Hewitt ..... 210/130
2,373,349 A * 4/1945 Serrell ..... 184/6.24
3,784,092 A * 1/1974 Gibson ..... 494/49
4,106,689 A 8/1978 Kozulla
4,165,032 A * 8/1979 Klingenberg ..... 494/49
5,603,829 A 2/1997 Baumann
5,779,618 A * 7/1998 Onodera et al. ..... 494/5
5,906,733 A * 5/1999 Purvey ..... 210/416.1
6,074,336 A * 6/2000 Purvey ..... 494/64
6,454,694 B1 * 9/2002 Herman et al. ..... 494/49
6,740,026 B2 * 5/2004 Samways ..... 494/49
6,821,241 B2 * 11/2004 Herman et al. ..... 494/5

FOREIGN PATENT DOCUMENTS

DE 4403425 A1 8/1994
WO 92/16303 * 10/1992

* cited by examiner

*Primary Examiner*—Charles E. Cooley
(74) *Attorney, Agent, or Firm*—Sonnenschein Nath & Rosenthal LLP

(57) ABSTRACT

A centrifuge for the purification of lubricating oil of an internal-combustion engine is provided which includes a housing with a removable cover, a housing-fixed shaft arranged in the housing and a centrifuge rotor which is rotatably mounted on the shaft and is replaceable. The shaft is hollow at least in its lower part and forms in its hollow inside a section of a lubricating oil supply canal, which canal is in flow connection with an inside of the centrifuge rotor mounted on the shaft over at least one orifice opening. The centrifuge also includes an adjustable valve plug arranged at the shaft and arranged to be held in an open position by the centrifuge rotor. The valve plug releases the orifice opening in the open position. The valve plug is also arranged to be transferred into a closing position and held in the closing position by a force created by at least one of a pressure of the lubricating oil and by a preloading component if the centrifuge rotor is missing. The valve plug plugs the orifice opening in the closing position.

19 Claims, 17 Drawing Sheets

Figure 1A:
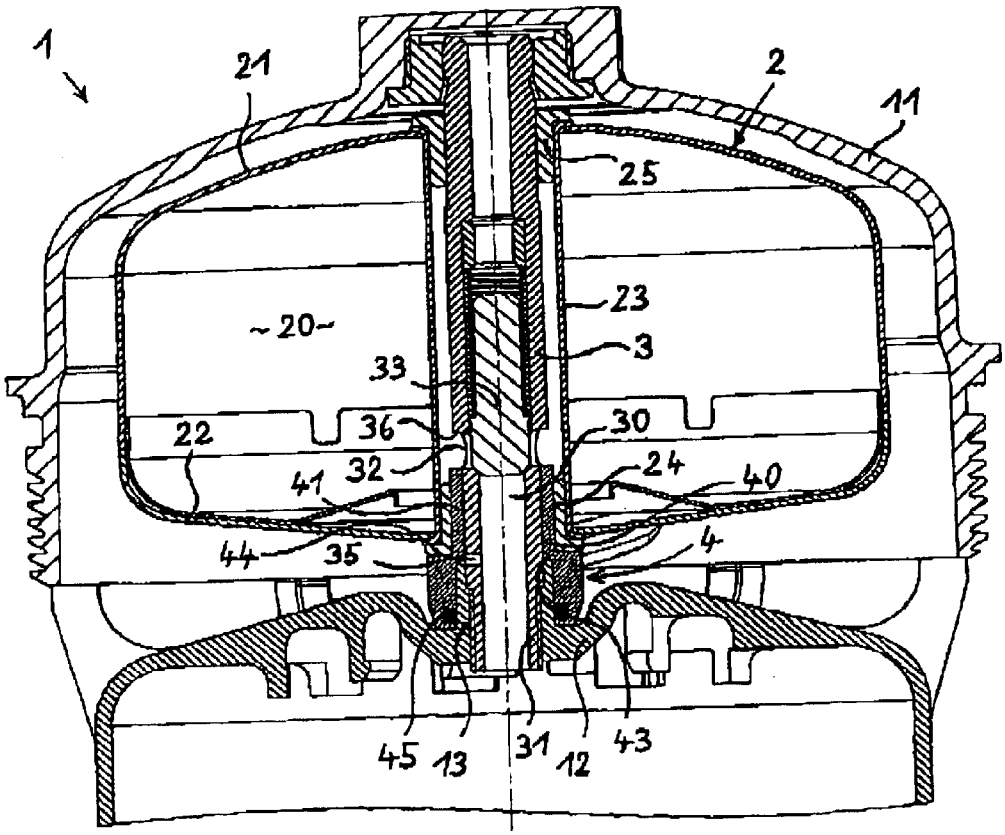

CENTRIFUGE FOR THE PURIFICATION OF LUBRICATING OIL OF AN INTERNAL-COMBUSTION ENGINE

BACKGROUND OF THE INVENTION

The present invention relates to a centrifuge for the purification of lubricating oil of an internal-combustion engine, with a housing with a removable cover, with a housing-fixed shaft arranged in the housing and with a centrifuge rotor, which is rotatably mounted on the shaft and is replaceable, whereby the shaft is hollow at least in its lower part and forms in its hollow inside a section of a lubricating oil supply canal, which is in flow connection with the inside of the centrifuge rotor mounted on the shaft over at least one orifice opening.

Centrifuges of the type initially specified are usually used as partial flow filters beside a filter cartridge. Thereby usually only a partial oil volume stream flows over the centrifuge, which is approximately 10% of the entire oil flow, which flows through the filter cartridge. In order to keep flow resistances low, the lubricating oil supply canal to the centrifuge is usually designed with a large cross section. The throttling of the oil volume stream through the centrifuge takes place basically exclusively by recoil nozzles provided at the centrifuge rotor, which rotate the centrifuge rotor by means of the lubricating oil flowing through. If the centrifuge rotor is erroneously not assembled, which can inadvertently happen for example during careless work at a maintenance service, this throttling is omitted and a very large partial oil volume stream flows through the bypass flow path of the centrifuge. Thus this very large partial oil volume stream is removed from the oil circuit and is no longer available for the lubrication of the appropriate internal-combustion engine. The operational reliability of the appropriate internal-combustion engine is thereby seriously endangered because a sufficient lubrication is no longer ensured.

It is therefore the task of the present invention to create a centrifuge of the type initially specified, with which it is ensured that even with the centrifuge rotor erroneously not assembled a sufficiently large oil volume stream is always available for the lubrication of the appropriate internal-combustion engine.

The present invention relates to a centrifuge for the purification of lubricating oil of an internal-combustion engine, with a housing with a removable cover, with a housing-fixed shaft arranged in the housing and with a centrifuge rotor, which is rotatably mounted on the shaft and is replaceable, whereby the shaft is hollow at least in its lower part and forms in its hollow inside a section of a lubricating oil supply canal, which is in flow connection with the inside of the centrifuge rotor mounted on the shaft over at least one orifice opening.

Centrifuges of the type initially specified are usually used as partial flow filters beside a filter cartridge. Thereby usually only a partial oil volume stream flows over the centrifuge, which is approximately 10% of the entire oil flow, which flows through the filter cartridge. In order to keep flow resistances low, the lubricating oil supply canal to the centrifuge is usually designed with a large cross section. The throttling of the oil volume stream through the centrifuge takes place basically exclusively by recoil nozzles provided at the centrifuge rotor, which rotate the centrifuge rotor by means of the lubricating oil flowing through. If the centrifuge rotor is erroneously not assembled, which can inadvertently happen for example during careless work at a maintenance service, this throttling is omitted and a very large partial oil volume stream flows through the bypass flow path of the centrifuge. Thus this very large partial oil volume stream is removed from the oil circuit and is no longer available for the lubrication of the appropriate internal-combustion engine. The operational reliability of the appropriate internal-combustion engine is thereby seriously endangered because a sufficient lubrication is no longer ensured.

It is therefore the task of the present invention to create a centrifuge of the type initially specified, with which it is ensured that even with the centrifuge rotor erroneously not assembled a sufficiently large oil volume stream is always available for the lubrication of the appropriate internal-combustion engine.

The solution of this is achieved according to the invention with a centrifuge of the type initially specified, which is characterized by the fact,

- that a movable closing element is arranged in or on the shaft,
- that the closing element can be held in an open position by the centrifuge rotor arranged in the housing, in which the closing element releases the orifice opening, and
- that the closing element can be transferred into a closing position and can be held in this closing position by a force created by a pressure of the lubricating oil or by a preloading component if the centrifuge rotor is missing, in which the closing element blocks the orifice opening.

It is achieved by the closing element in the centrifuge provided according to the invention, that the centrifuge releases the partial oil volume stream with the assembled centrifuge rotor and that the flow path for the lubricating oil is closed with the centrifuge rotor missing in the centrifuge. Thus no more lubricating oil can flow through the lateral branch of the oil circuit, in which the centrifuge is situated, with an erroneously missing centrifuge rotor, apart from small possible leakage amounts. Thus it is guaranteed that the entire lubricating oil amount is available for the lubrication of the appropriate internal-combustion engine. Filtering of the lubricating oil takes place further via the filter cartridge, which is usually present beside the centrifuge; only micro filtering through the centrifuge in the bypass flow is omitted. This missing micro filtering however does not pose an immediate danger of damage for the appropriate internal-combustion engine. Thus the operational reliability of the internal-combustion engine is ensured, even if the centrifuge rotor of the centrifuge is erroneously not assembled.

Preferably a sleeve, which is movable in the longitudinal direction of the shaft, is arranged as a closing element in the hollow inside of the shaft or on the outer circumference of the shaft, whereby the orifice opening is a lateral opening from the hollow inside of the shaft outward. Opening and closing of the orifice opening then take place simply via axial shifting of the sleeve either away from the orifice opening or over the orifice opening. Thereby a particularly simple design is achieved, which requires only a low additional manufacturing expenditure compared to a conventional centrifuge.

The invention suggests further the fact that a lower end piece of the shaft itself or a shaft pedestal supporting the shaft exhibits an increased outside diameter in relation to the remaining shaft and that the sleeve sitting outside on the shaft exhibits fitting to this a stepped interior and outside diameter with a larger diameter in its lower part and with a smaller diameter in its upper part. A sleeve arranged in such a way adapts itself to given technical conditions and requires no complex modifications or adaptations on the side of the shaft or a shaft pedestal supporting said shaft.

Preferably it is provided that the shaft exhibits further a lateral opening from its hollow inside outward at the height of the larger inside diameter of the sleeve and that the sleeve is sealed in its lower end area at its interior diameter against the outer circumference of the shaft or the shaft pedestal by means of a slide seal. With this arrangement of the centrifuge a hydraulic adjustment of the sleeve in its closing direction is achieved with the pressure of the lubricating oil with a missing rotor.

Alternatively at least one pressure spring can be arranged as a preloading component between the sleeve and a pedestal part of the housing. In this design of the centrifuge a mechanical adjustment of the sleeve is caused by the pressure spring in a closing direction.

The rotor provides in each case the maintenance of the open position of the sleeve, if it is assembled in the centrifuge.

In order to secure the sleeve against torsion and to ensure thereby that only the parts of the bearings supporting the centrifuge rotor turn relative to each other, it is intended that the sleeve exhibits arms running radially from the outside inward if designed as an outer sleeve and running radially from the inside outward if designed as an inner sleeve, which are situated in longitudinal slots of the lower end area of the shaft and which guide the sleeve secured against torsion. The arms provide the desired protection against torsion, they however do not obstruct the axial adjustment of the sleeve. If necessary the arms can also be designed so long that they exceed radially over the longitudinal slots of the shaft. These exceeding areas of the arms can be used for further functions, for example for the support of a spring as a preloading component.

A further embodiment of the centrifuge provides that a lower pivot bearing of the centrifuge rotor be designed as a shaft-fixed friction bearing or as a rotor-fixed friction bearing. In the design as a rotor-fixed friction bearing, the friction bearing is replaced each time the centrifuge rotor is replaced, which is to be preferred if during the use time of a centrifuge rotor a noticeable wear of the friction bearing is to be expected. The alternative design as a shaft-fixed friction bearing retains the friction bearing also during an exchange of the centrifuge rotor. This design is then suitable if over the use time of the centrifuge altogether no too large of a wear of the friction bearing is expected.

Alternatively, a lower pivot bearing of the centrifuge rotor can be designed as a shaft-fixed antifriction bearing. Such an antifriction bearing is a more complex and thus more expensive bearing, however it is particularly wear resistant and particularly friction-less. For this reason, such a more complex antifriction bearing is suitably designed only shaft-fixed, so that it can be further used after an exchange of the centrifuge rotor.

Regarding the antifriction bearing, it is further provided that it is preferably arranged at the interior circumference of the sleeve and that it is together with this axially movable on the shaft. With the assembled rotor then the sleeve turns together with the rotor, whose lower end sits on the sleeve.

The invention suggests further that a pedestal part of the housing supporting the shaft serves for the limitation of the shift path of the sleeve in its opening direction. For this design no special component is required for the limitation of the shift path of the sleeve in its opening direction, which keeps production costs low.

The shaft exhibits a stop for the limitation of the shift path of the sleeve in its closing direction. Thereby it is ensured that the sleeve can move only within the shift path required for its function. The stop on the shaft can be designed as one part with the shaft or also as a component, which is subsequently assembled at the shaft, for example a retainer ring.

In order to provide during low lubricating oil pressure the lubricating oil in the full amount for the lubrication of an appropriate internal-combustion engine, it is further provided that a minimum pressure valve be integrated into the shaft, which releases a supply of lubricating oil to the centrifuge rotor only when achieving a preset minimum lubricating oil pressure. As long as the lubricating oil pressure is below this minimum pressure, the entire lubricating oil amount flows through the main flow and thus to the lubrication fittings of the internal-combustion engine. A direct flow of the centrifuge does not yet take place in this status. A partial stream of the lubricating oil flows only then through the centrifuge if the preset minimum lubricating oil pressure is reached or exceeded.

In order to protect the centrifuge and its centrifuge rotor from damage by a too high lubricating oil pressure, the invention suggests a design that with the centrifuge rotor inserted into the housing, the closing element is movable in a closing direction against a preloading force working in its opening direction by a force which is created by a lubricating oil pressure above a preset upper lubricating oil limiting pressure. Hereby it is achieved that with a reaching or exceeding of an upper lubricating oil limiting pressure, the closing element is transferred by the lubricating oil into its closing position, whereby a further inflow from lubricating oil to the centrifuge is prevented. Thus it is safely eliminated that too large and harmful lubricating oil pressures can occur within the area of the centrifuge.

In a further embodiment of the design of the centrifuge described before, it is intended that at least one spring is provided between the bottom of the centrifuge rotor and the closing element, that the spring preloads the closing element with a force aiming in its opening direction and that the closing element is movable in the closing direction against the force of this spring which is created by the force of the upper lubricating oil limiting pressure. The generation of the preloading force by a spring is technically simple and reliable. Additionally a desired lubricating oil limiting pressure can be defined trouble-free by selection of suitable spring characteristic values, at which the closing element shuts off the oil flow through the centrifuge.

Finally, the invention furthermore suggests that a guide sleeve, which is movable coaxially to the shaft, is arranged between the bottom of the centrifuge rotor and the spring, which is, if the centrifuge rotor is inserted, held in a lower final shift position by said centrifuge rotor and which assumes an upper final shift position, if the centrifuge rotor is not present, due to a lubricating oil pressure force or a spring force. With this design a technically simple solution is achieved to ensure a closing of the oil flow path to the centrifuge if the centrifuge rotor is missing and to cause at the same time the blocking of the oil flow path through the centrifuge during an excessively high lubricating oil pressure.

Figure 6A:
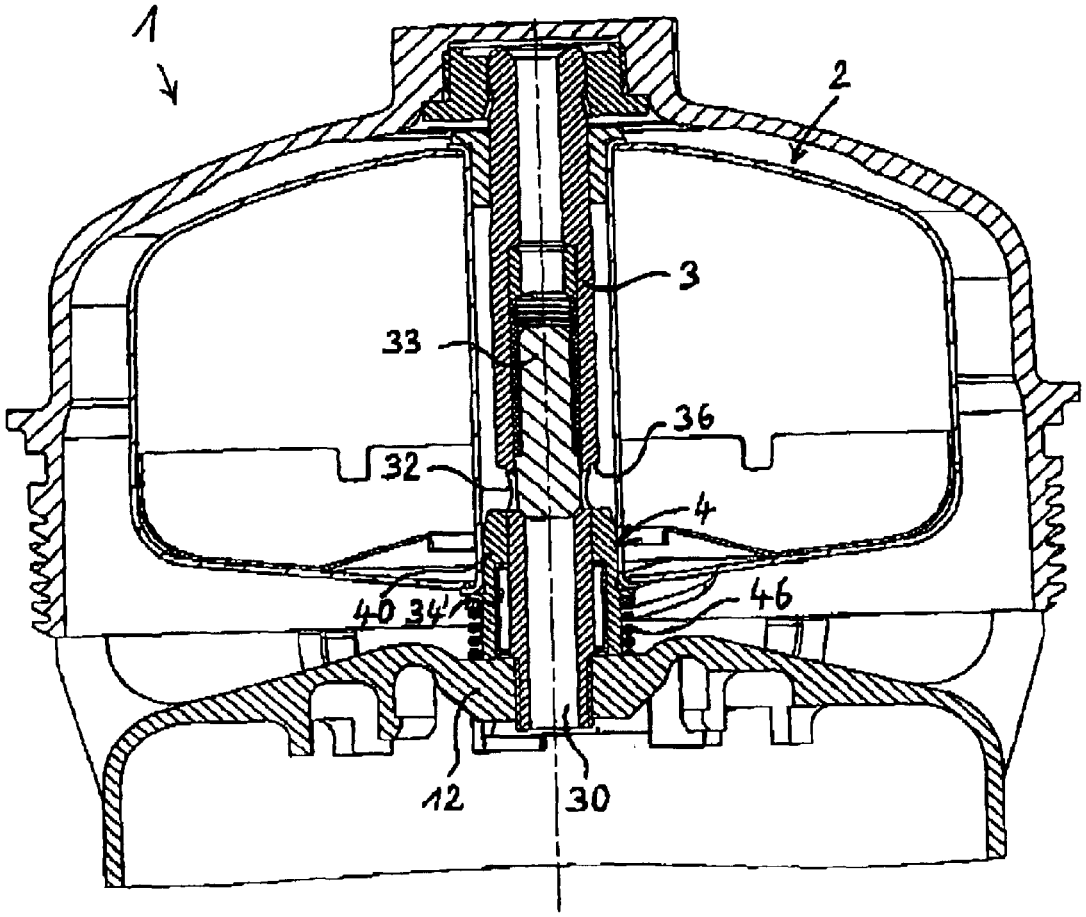
Figure 6B:
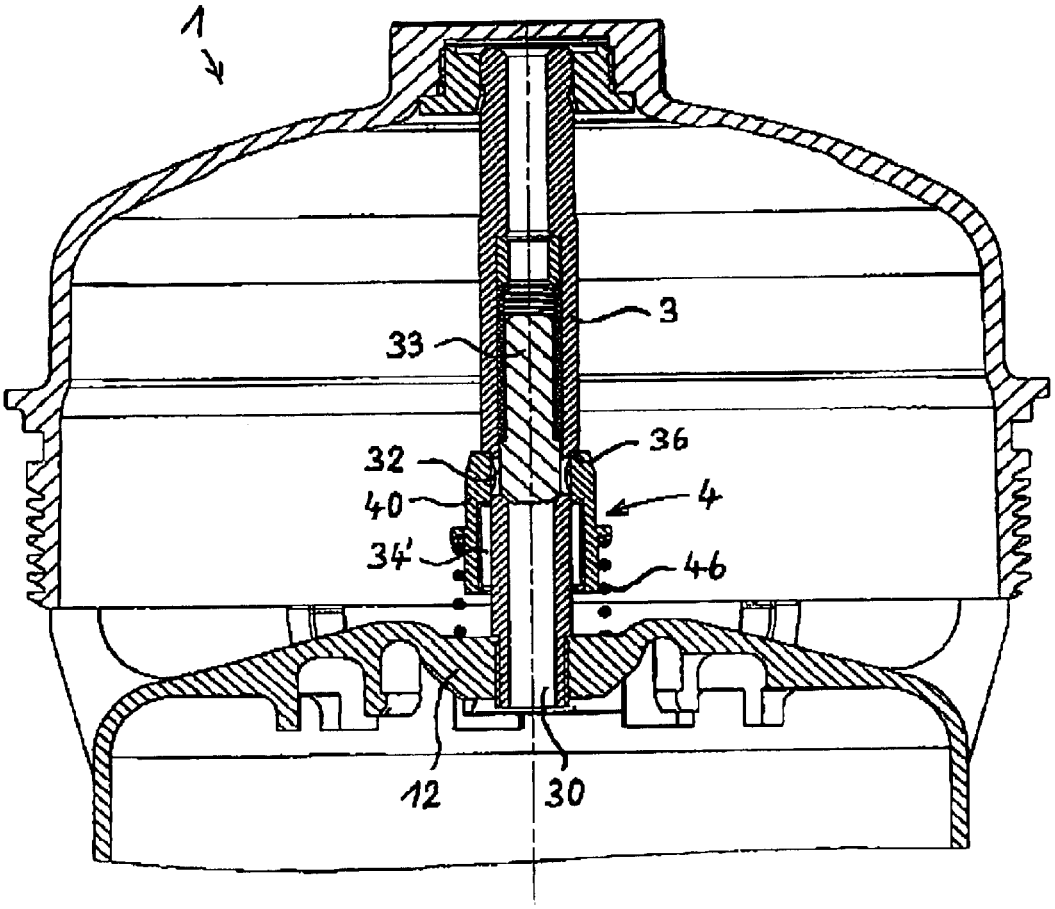
Figure 7A:
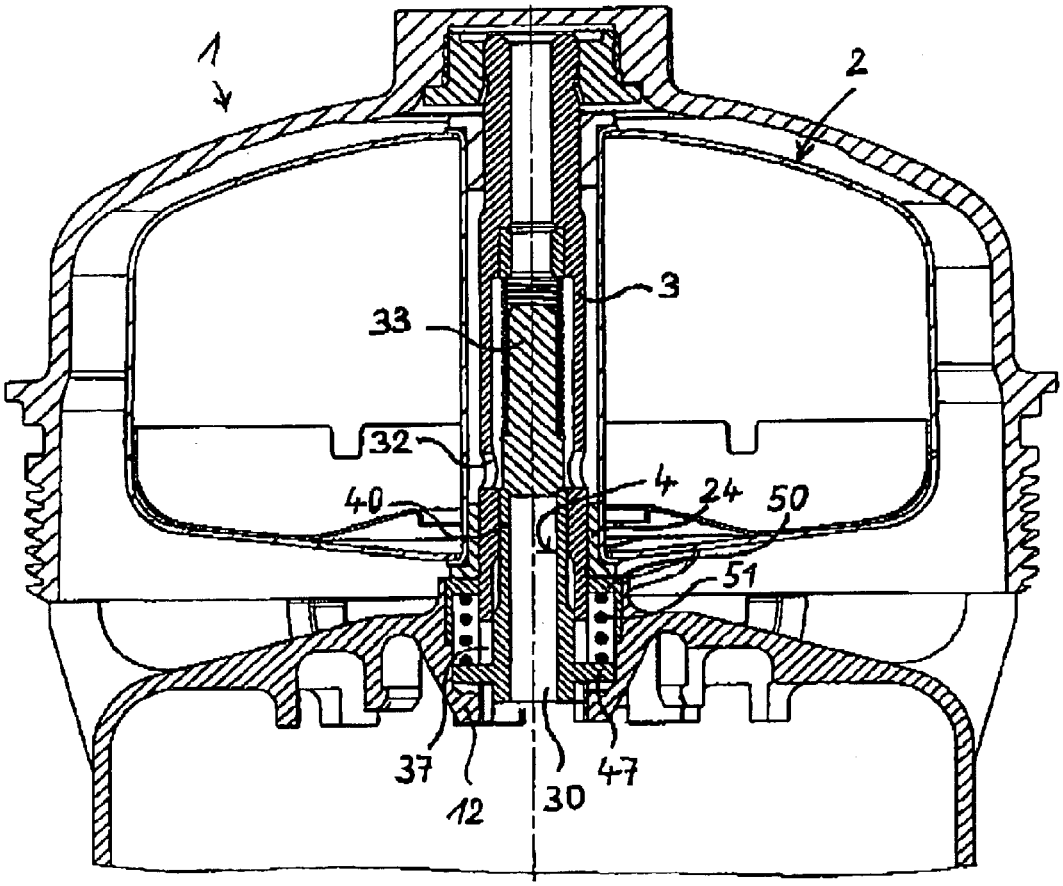
Figure 7B:
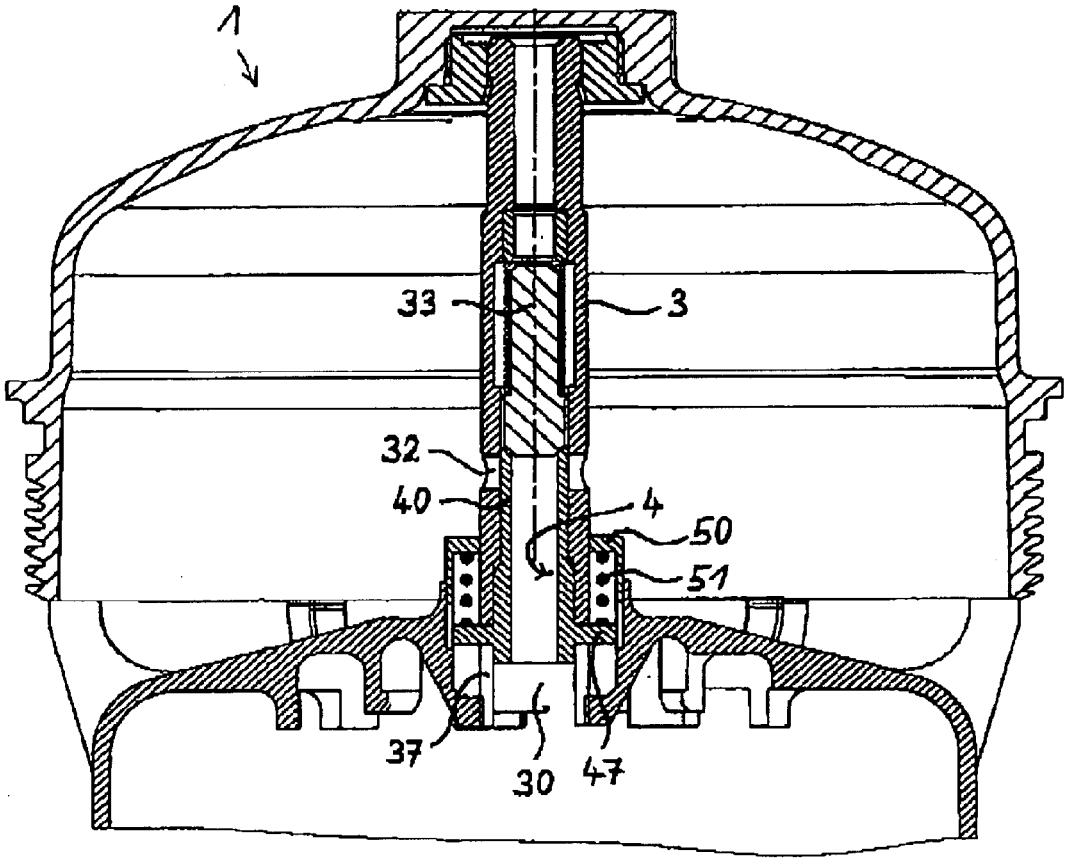
Figure 7C:
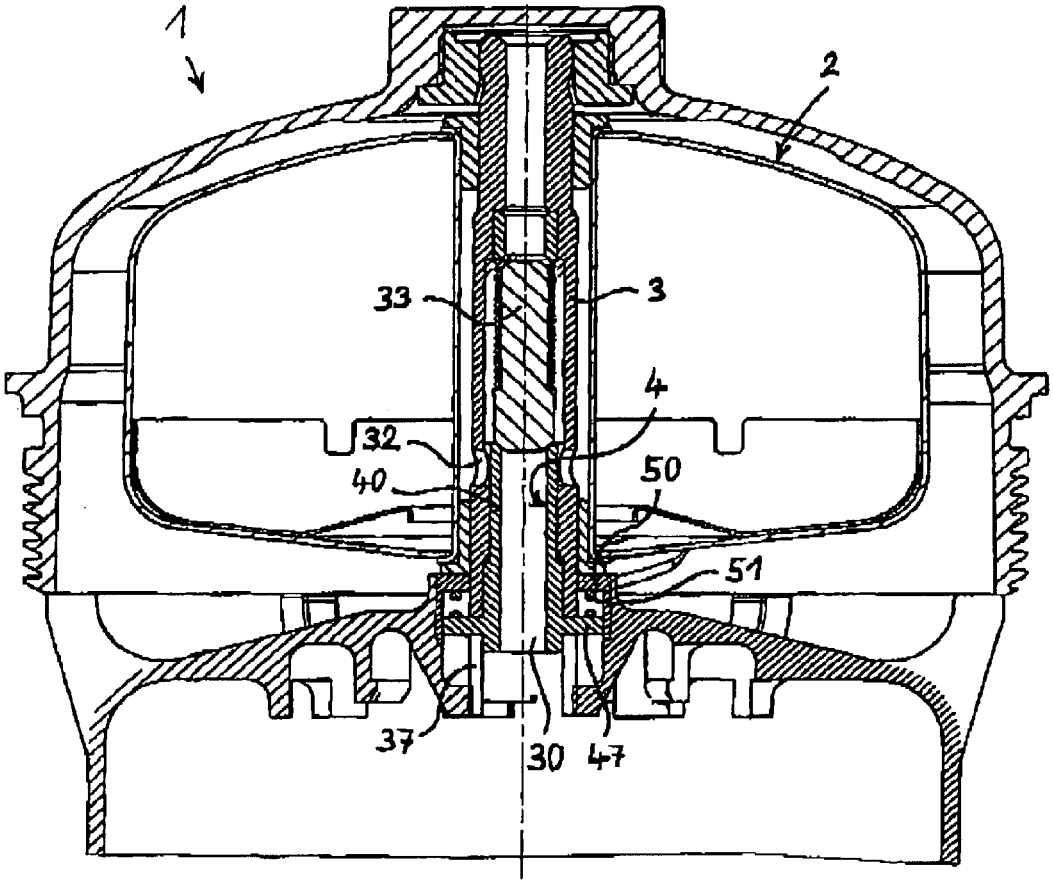
Figure 8:
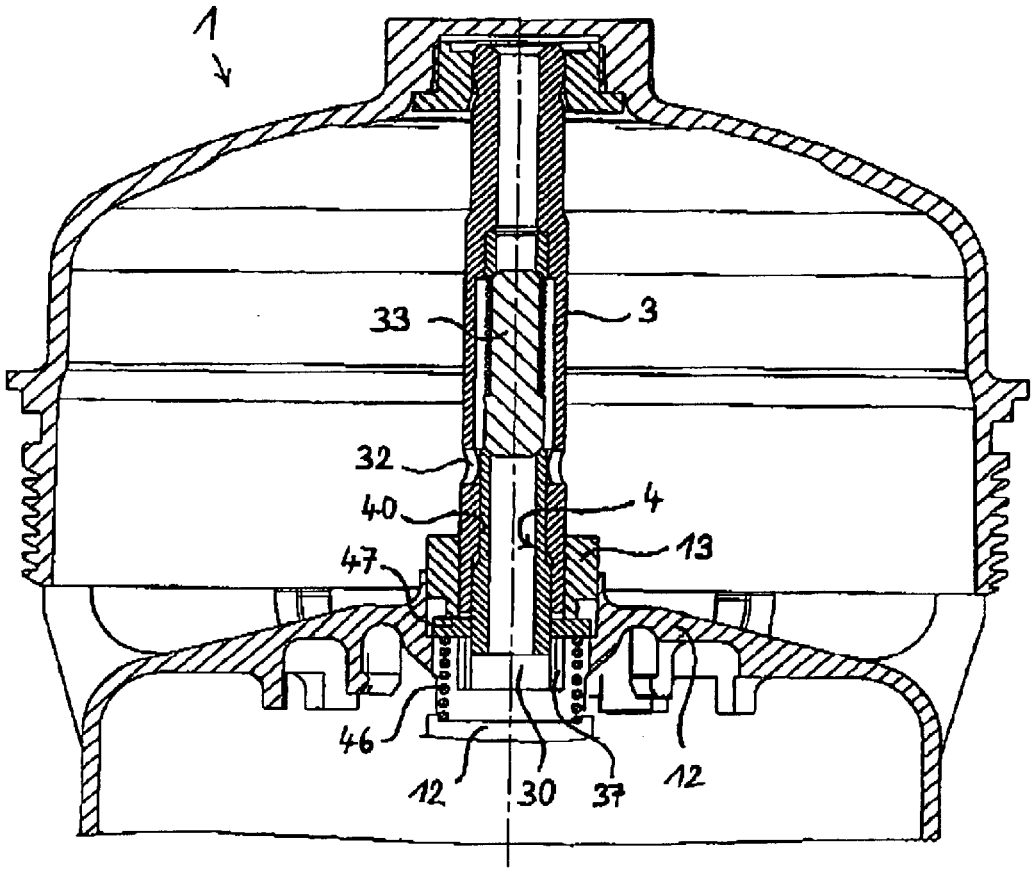
Figure 9:
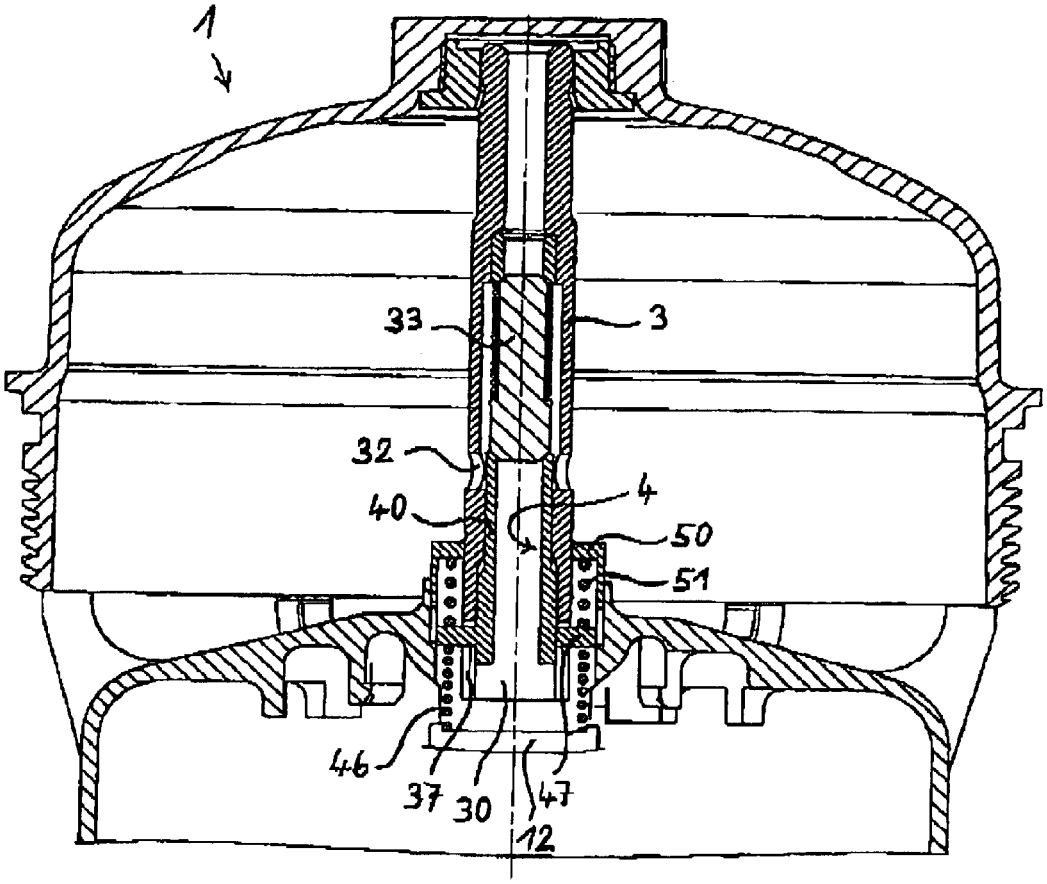

Following design examples of the invention are described using a drawing. The figures of the drawing show:

FIG. 1*a*–FIG. 7*a* illustrate in each case in cross-section different versions of a centrifuge in each case with the assembled centrifuge rotor, FIG. 1*b*–FIG. 7*b* illustrate in each case in the same representation the centrifuges from FIGS. 1*a*–7*a*, now however in each case without the centrifuge rotor, FIG. 7*c* illustrates the centrifuge from FIGS. 7*a* and 7*b* in a status with a lubricating oil pressure above an upper pressure limiting value, FIG. 8 illustrates a centrifuge without centrifuge rotor in a further design, likewise in cross-section, and FIG. 9 illustrates a further centrifuge in the same representation, in a status without centrifuge rotor.

FIG. 1*a* of the drawing shows a first centrifuge 1, which is a part of a purification setting for the lubricating oil of an internal-combustion engine. Besides the centrifuge 1 the purification setting comprises an oil filter with a filter cartridge here not represented, which is located beneath the centrifuge 1. The filter cartridge is located in the main flow of the oil system; a partial flow of it, in the order of magnitude of approximately 10%, is usually branched off after the filtering by the filter cartridge and piped for the separation of finest dirt particles through the centrifuge 1. The lubricating oil coming from the filter cartridge flows during the operation of the internal-combustion engine through the hollow inside 30 of a shaft 3, which is arranged housing-fixed underneath a removable cover 11. The cover 11 is a part of the centrifuge housing, which is in all other respects not represented. A centrifuge rotor 2 is rotatably mounted on the shaft 3 by means of two friction bearings 24, 25; the centrifuge rotor consists as usual of a center tube 23, a globe 21 and a base 22. The lubricating oil can flow over at least one orifice opening 32 out of the hollow inside 30 of the shaft 3 into the inside 20 of the centrifuge rotor 2. From there the lubricating oil exits through here not visible recoil nozzles and thereby brings the rotor 2 into a fast rotation, which causes the dirt particle separation through centrifugal forces. The lubricating oil drains pressure-free from the housing area underneath the centrifuge rotor 2, usually into the sump pan of the appropriate internal-combustion engine.

As FIG. 1*a* shows further, additionally a valve 33 is provided in the hollow inside 30 of the shaft 3, which ensures as a minimum pressure valve that the lubricating oil arrives in the orifice opening or orifice openings 32 and therefore into the centrifuge rotor 2 from the hollow inside 30 of the shaft 3 only after reaching a certain minimum lubricating oil pressure. In the status shown in FIG. 1*a*, the valve 33 is in its closed position, which means that a sufficiently high pressure is not yet present to open the valve 33.

On the lower end area 31 of the shaft 3, which is located in a pedestal part 12 of the centrifuge, a closing element 4 is arranged outside. A stepped sleeve 40 forms the closing element 4, which is movable in an axial direction of the shaft 3. The sleeve 40 is sealed close to its lower end by a sealing ring 45 against the outer circumference of a shaft pedestal 13 containing the lower end of the shaft 3. In the area of the larger diameter, thus within the area of the lower part of the sleeve 40, a further opening 35 is provided in the shaft 3, which connects the hollow inside 30 of the shaft 3 with the inside of the sleeve 40.

As mentioned, the sleeve 40 exhibits a stepped design, whereby it exhibits on the outside a step 41 pointing upward. On this step 41 the centrifuge rotor 2 with its here rotor-fixed lower friction bearing 24 mounts in its assembled status. The centrifuge rotor 2 for its part is held in its position by the cover 11, which forms a part of the housing. Thus the centrifuge rotor 2 ensures that with assembled rotor 2 the sleeve 40 takes and retains its lower final shift position.

If the appropriate internal-combustion engine operates, an appropriate oil pump creates a lubricating oil pressure. The valve 33 remains still closed at an oil pressure below a minimum pressure, e.g. 2 bars. Pressure acts upon the sleeve 4 however via an opening 35 in the shaft 3 on an annulus area, which is pointing downwards and is situated radially inside and below the external level 44. The hydraulic force resulting from this shifts the sleeve 4 and the rotor 2 upward, until the cover 11 or a bearing application located in said cover prevents a further upward shift. As soon as the lubricating oil pressure exceeds the minimum pressure, the lubricating oil is able to shift the valve 33 into its open position. Thereby then the centrifuge 1 releases a bypass flow of the lubricating oil, the rotor 2 fills with lubricating oil and is at operating pressure. Now also an upward pointing annulus area of the sleeve 4, which is larger than the first acted upon, downwards pointing annulus area of the sleeve 4, is acted upon with pressure. Thus the sleeve 4 is pressed downwards again and the rotor 2 can turn freely and friction-less without an axial clamping or braking by the sleeve 4.

Figure 1B:
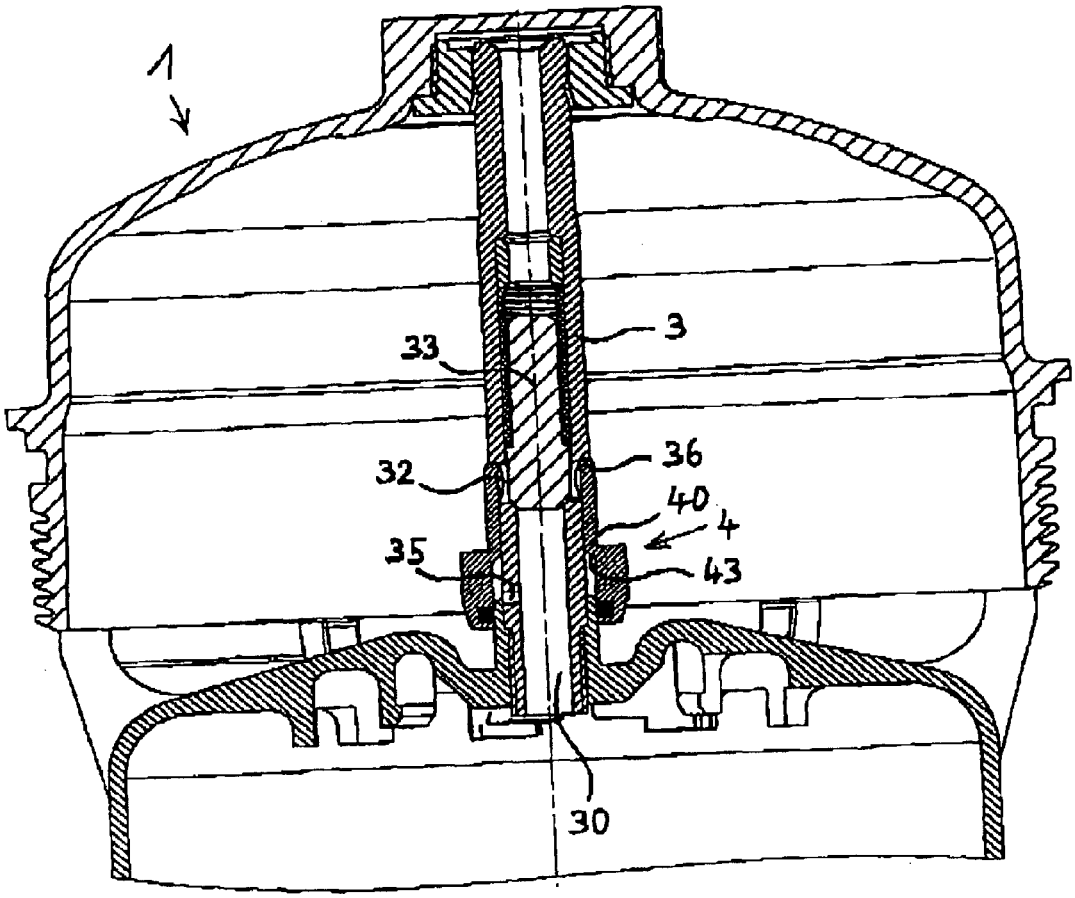

FIG. 1*b* shows the centrifuge 1 from FIG. 1*a*, now however in a status with a missing centrifuge rotor 2, which can erroneously occur for example during improper or careless maintenance. From FIG. 1*b* it is evident that now the sleeve 40 forming the closing element 4 assumed a position shifted upward. The sleeve 40 gets into this position by a lubricating oil pressure of the lubricating oil present in the hollow inside 30 of the shaft 3. This lubricating oil enters the inside of the sleeve 4 through the opening 35 and causes there an axial transverse force upward. This shift of the sleeve 40 leads to the fact that the top of the sleeve 40 covers and therefore closes the orifice openings 32. In this position then the sleeve 40 rests with its upper end at a stop 36, which is designed as one piece with the shaft 3. This way it is ensured that no oil flow flows through the bypass flow path with a missing centrifuge rotor 2. The lubricating oil is thus not removed from the internal-combustion engine. By automatically closing the bypass flow path through the centrifuge 1, the entire lubricating oil amount of the internal-combustion engine is made available for its lubrication. At the most, small leakage amounts, which are not relevant, can still flow through the bypass flow through the centrifuge 1. This closing of the bypass flow path through the centrifuge 1 also does not change, if the lubricating oil pressure continues to rise and the valve 33 reaches its open position. The sleeve 40 still ensures a closing of the orifice openings 32 even with an open valve 33.

Figure 2A:
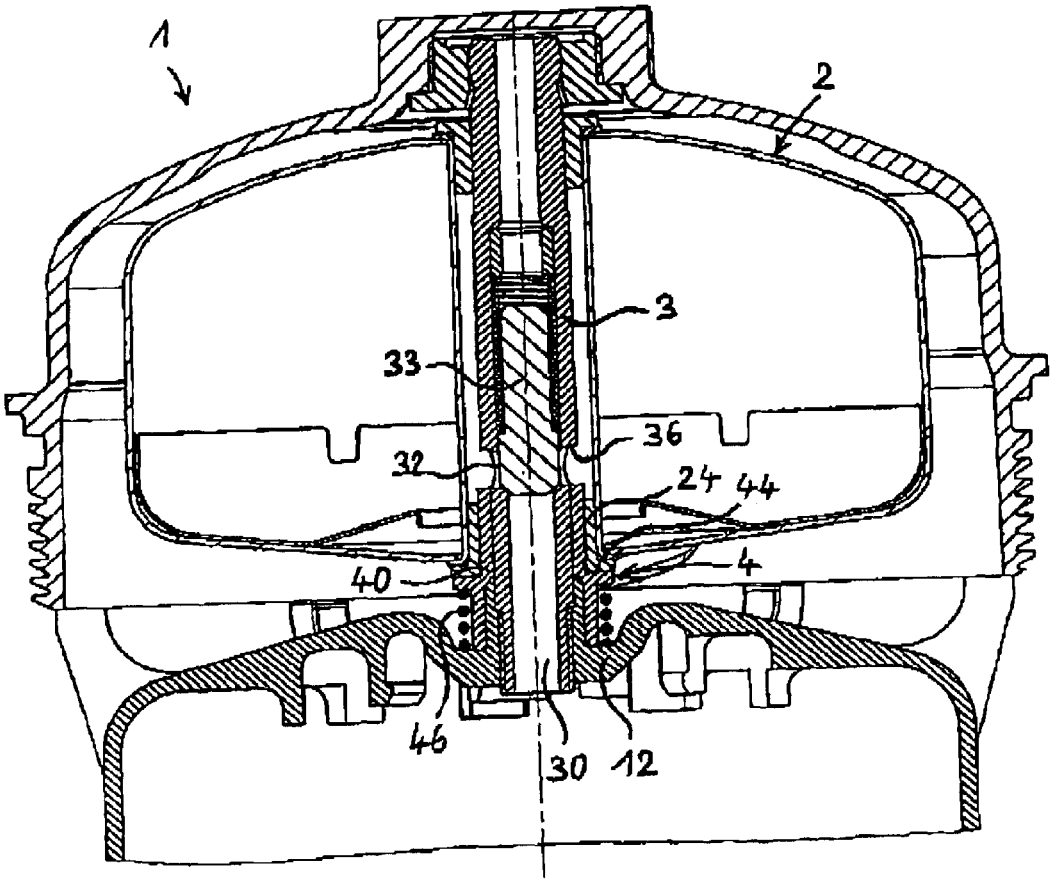

FIG. 2*a* shows a centrifuge 1, in which the axial shift of the valve blocks 4 also formed here by a sleeve 40 does not take place via the lubricating oil pressure but via the force of a spring 46. In the status shown in FIG. 2*a*, in which the centrifuge rotor 2 is located in the centrifuge 1, the centrifuge rotor 2 with its rotor-fixed lower friction bearing 24 presses the axially movable sleeve 4 downwards against the force of the spring 46.

The sleeve 40 is now in a position, in which it unblocks the orifice openings 32. As soon as the oil pressure is sufficiently large to open the minimum pressure valve 33, the lubricating oil flows through the centrifuge with its centrifuge rotor 2 in a usual manner.

Figure 2B:
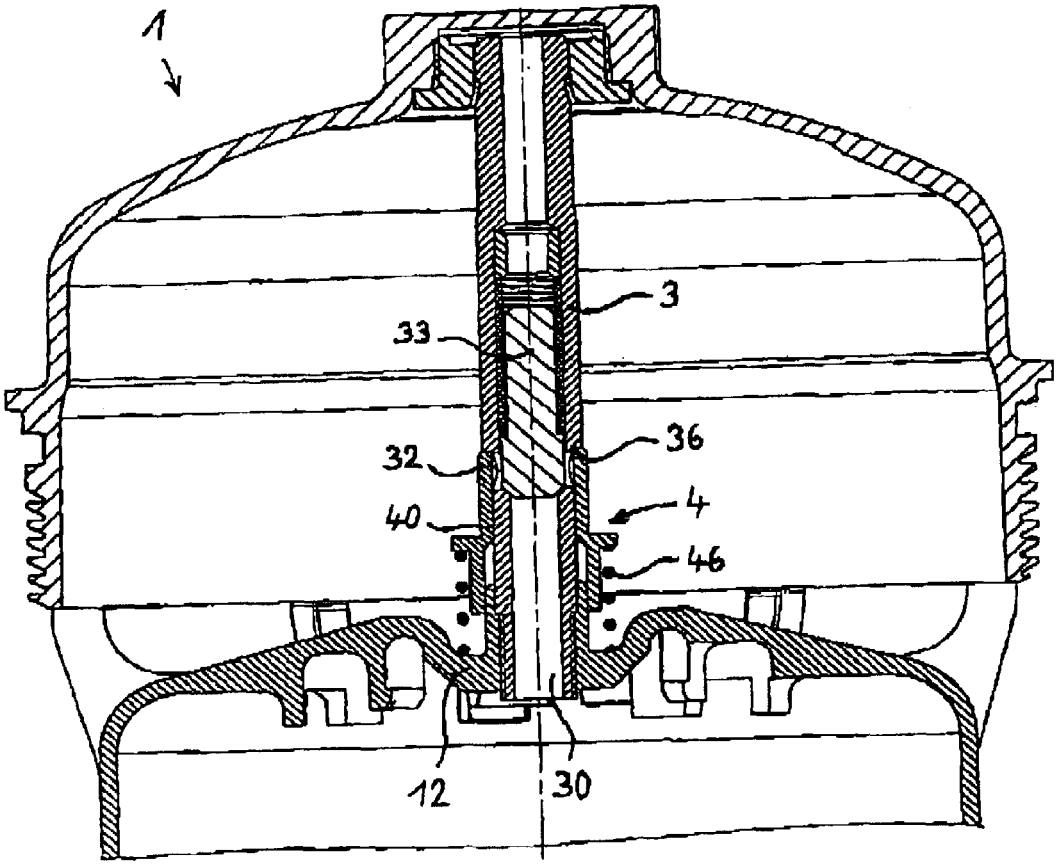

FIG. 2*b* shows the centrifuge from FIG. 2*a* with a missing centrifuge rotor. Since now the centrifuge rotor 2 does not act upon the sleeve 40 anymore, the pressure spring 46 is now in a position to shift the sleeve 40 in the axial direction of the shaft 3 upward until it is laying against the stop 36 at the shaft 3. In this upper final shift position of the sleeve 40, this sleeve again closes the orifice openings 32, so that a lubricating oil stream through the bypass flow path through the centrifuge 1 is prevented. The blocking of the bypass flow path is also here independent of the fact of whether the minimum pressure valve 33 is in its closed position, as shown in FIG. 2*b*, or in its open position with a somewhat higher lubricating oil pressure.

Figure 3A:
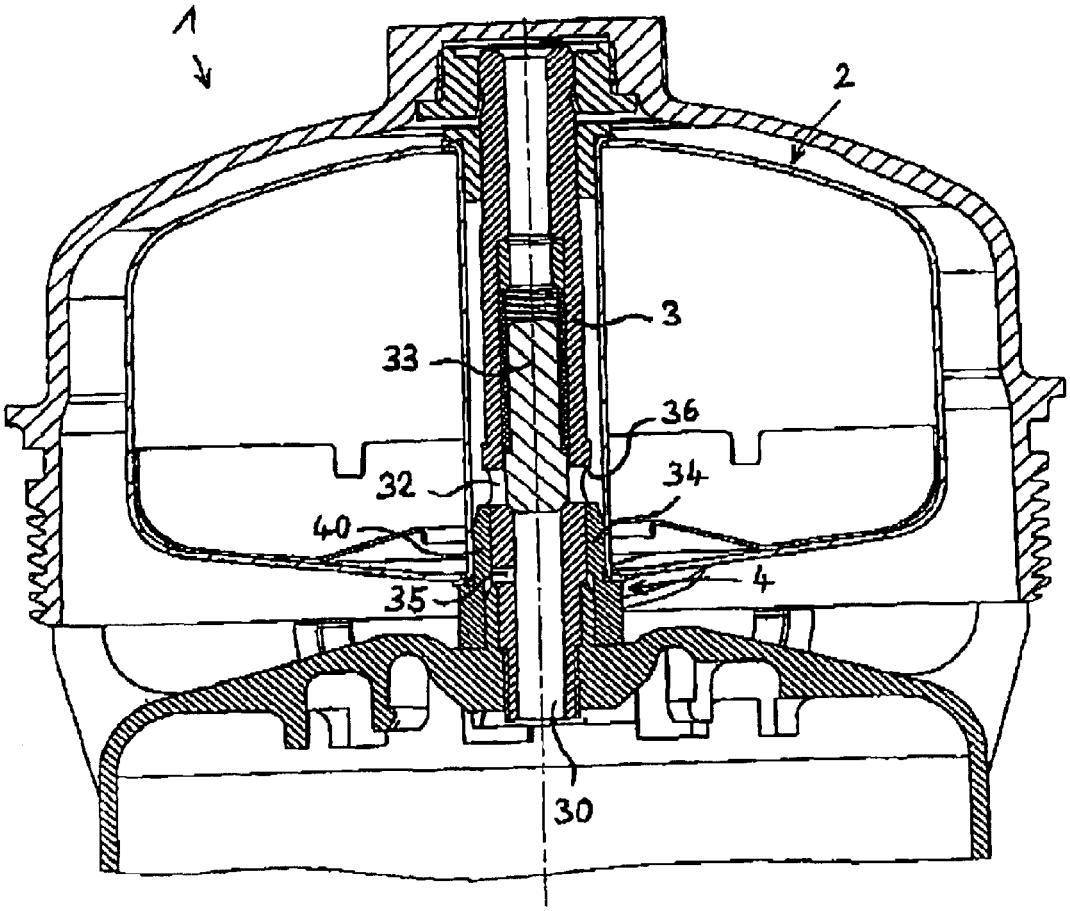
Figure 3B:
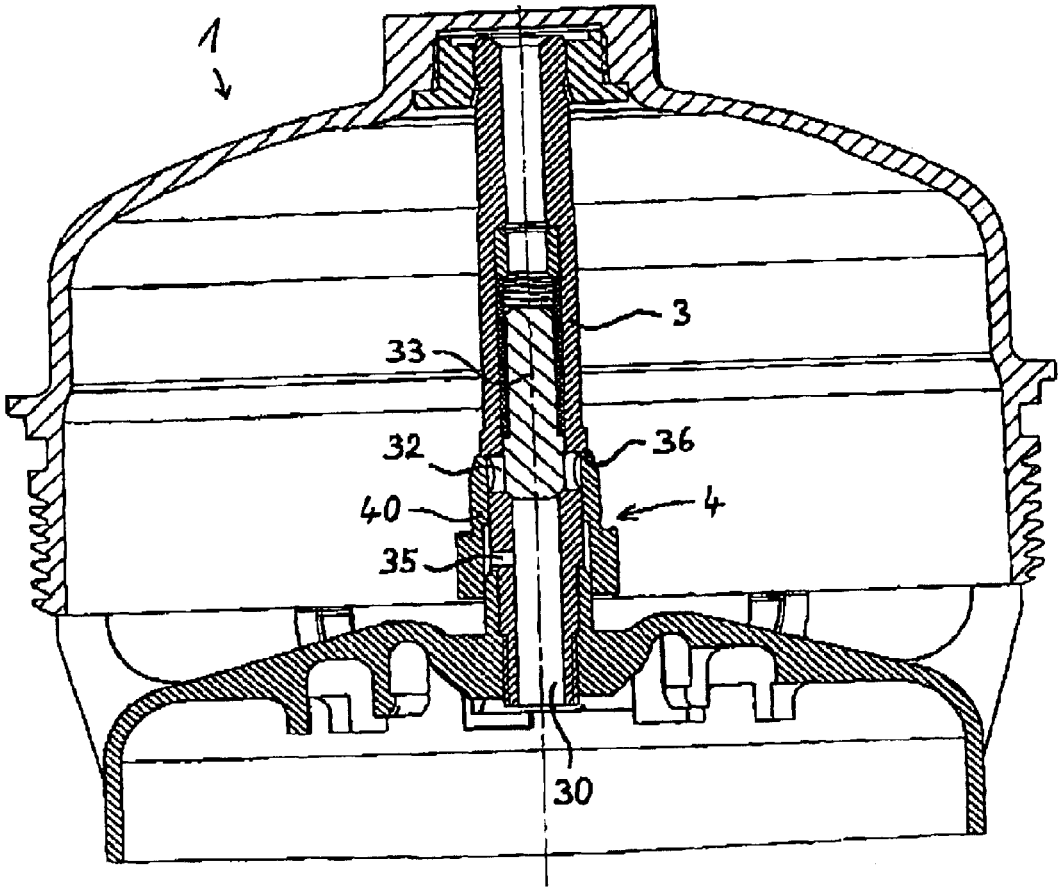

FIGS. 3*a* and 3*b* show a centrifuge 1, which differs from the centrifuge 1 in accordance with FIGS. 1*a* and 1*b* in the fact that it exhibits a shaft-fixed friction bearing 34 as a lower bearing for the centrifuge rotor 2. The closing element 4 is also here again designed as a sleeve 40, which is axially movable on the outer circumference of the lower part of the shaft 3. In the status in accordance with FIG. 3*a*, the rotor 2 assembled in the centrifuge 1 ensures that the sleeve 40 is pressed into its lower final shift position and held in this position. In this position of the sleeve 40, the sleeve 40 does not cover the orifice openings 32 from the hollow inside 30 to the centrifuge rotor 2. If the lubricating oil pressure reaches a minimum pressure during operation of the internal-combustion engine, the lubricating oil provides an opening of the minimum pressure valve 33 and the oil flow flows in the desired way as bypass flow partially through the centrifuge rotor 2.

In FIG. 3*b* the status of the centrifuge from FIG. 3*a* is represented with a missing centrifuge rotor. Here now the lubricating oil pressure ensures during operation of the internal-combustion engine that through the opening 35 an oil pressure acts upon the sleeve 40 from below upward seen in the axial direction. This force caused by the oil pressure shifts the sleeve 40 upward against the stop 36 designed at the shaft 3. The sleeve 40 covers the orifice openings 32 in this upper final shift position, so that the bypass flow for the lubricating oil through the centrifuge 1 is blocked. This blocked status is maintained, independently of whether the minimum pressure valve 33 is in its open position or in its closed position. At the same time the sleeve 40 forms the shaft-fixed lower friction bearing for the rotatable support of the centrifuge rotor 2 in this design of the centrifuge 1.

Figure 4A:
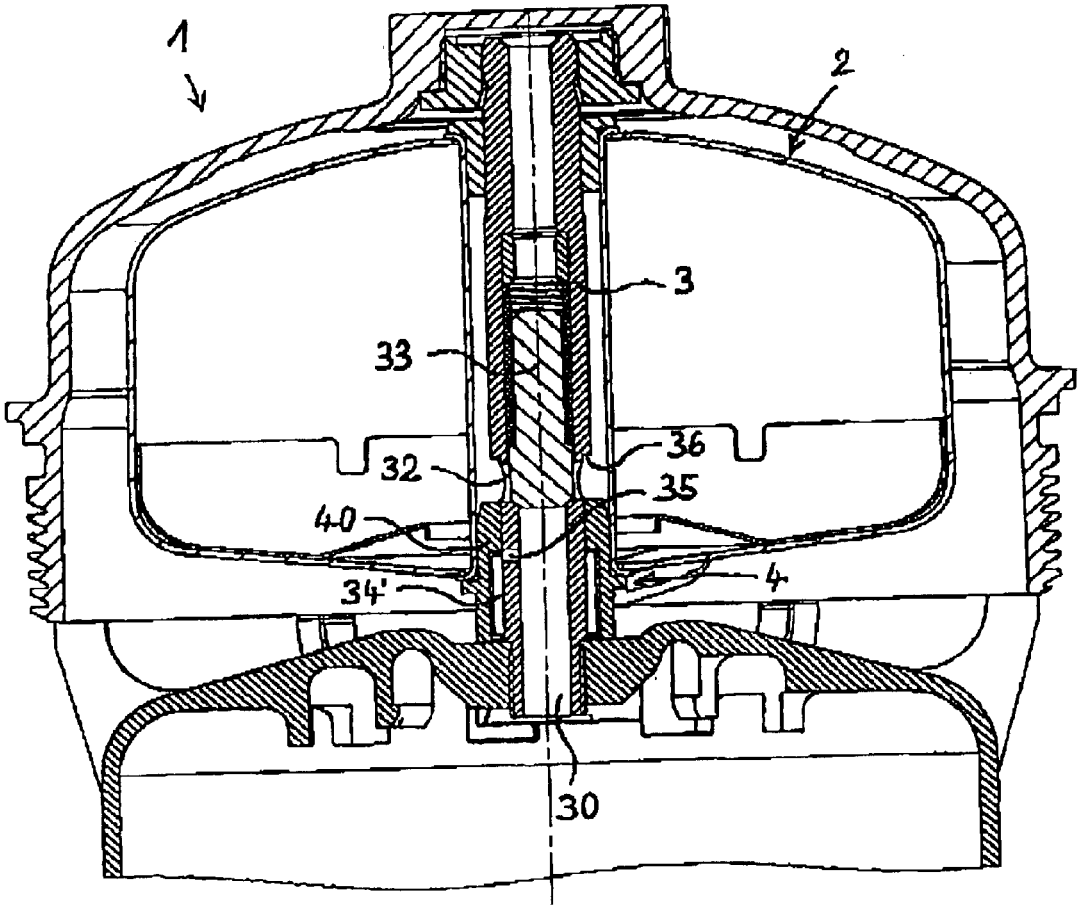
Figure 4B:
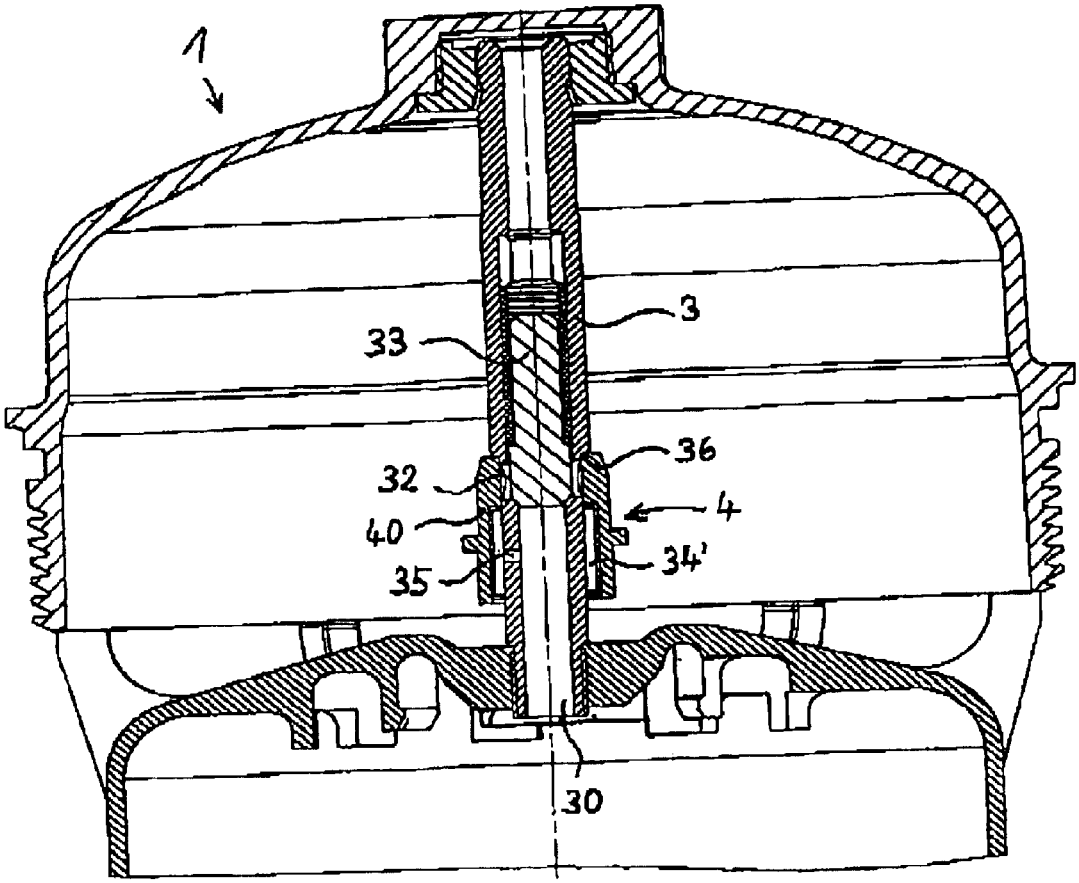

FIGS. 4*a* and 4*b* of the drawing show a design of the centrifuge 1, in which it is substantial that the lower bearing of the centrifuge rotor 2 is formed by a shaft-fixed antifriction bearing 34'. This antifriction bearing 34' is located in the interior circumference of the closing element 4, which is also here designed as a sleeve 40, and is movable on the shaft 3 together with the sleeve 40 in the axial direction of the shaft 3. The shifting of the sleeve 40 is here again caused by the oil pressure, which disseminates through the opening 35 on the inside of the sleeve 40.

In the status in accordance with FIG. 4*a*, thus with assembled centrifuge rotor 2, said centrifuge rotor ensures that the sleeve 40 assumes its lower final shift position. The sleeve 40 rotates with the operating centrifuge 1 together with the centrifuge rotor 2 around the shaft 3 with the antifriction bearing 34' in-between. Also here the minimum pressure valve 33 is additionally provided, which still assumes in the status in accordance with FIG. 4 its closed position. The valve 33 changes into its open position when reaching a minimum lubricating oil pressure and a partial oil flow can flow through the centrifuge 1.

FIG. 4*b* shows again the status of the centrifuge 1 with a missing centrifuge rotor. When an oil pressure is present in the hollow inside 30 of the shaft 3, this oil pressure disseminates through the opening 35 into the inside of the sleeve 40. There the oil pressure causes a force on the sleeve 40, directed upward in the axial direction of the shaft 3, whereby said sleeve is shifted together with the antifriction bearing 34' on the lower part of the shaft 3 upward to a stop 36 provided at the shaft 3. In this upper final shift position the sleeve 40 again covers the orifice openings 32, so that even with an open minimum pressure valve 33, no oil flow from the hollow inside 30 of the shaft 3 can reach the inside of the cover 3, thus into a pressure-free area. Thus it is also ensured with this design of the centrifuge 1 that with a missing centrifuge rotor, the bypass flow through the centrifuge 1 is blocked and therefore the entire lubricating oil amount is made available for the internal-combustion engine.

Figure 5A:
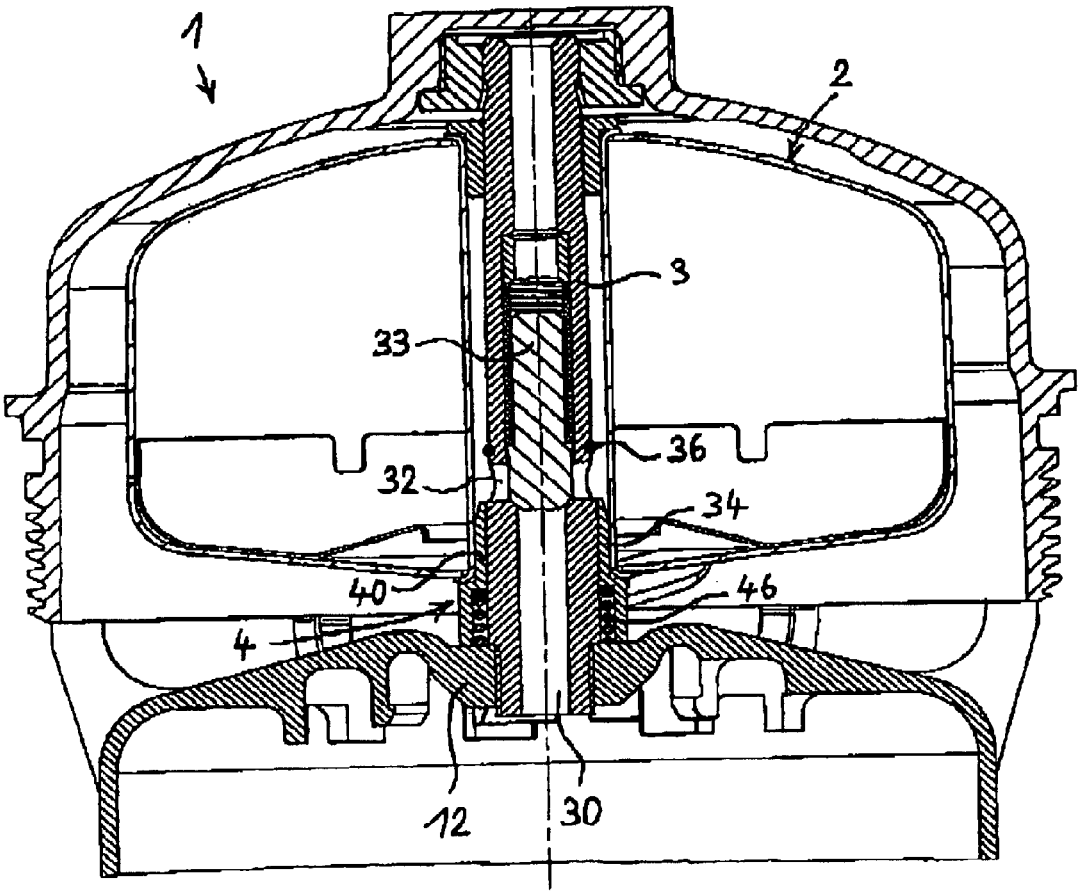
Figure 5B:
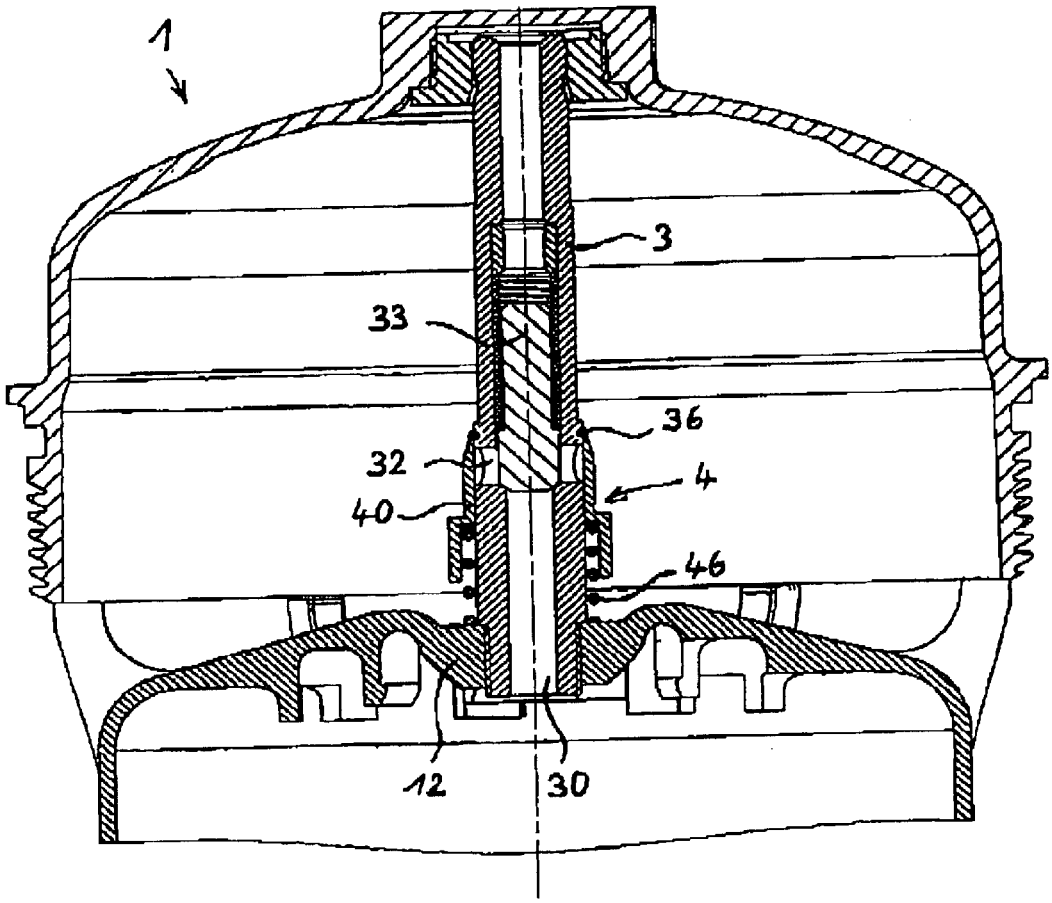

FIGS. 5*a* and 5*b* of the drawing show a design of the centrifuge 1, for which it is typical that the lower bearing of the centrifuge rotor 2 is a shaft-fixed friction bearing 34. The shifting of the sleeve 40, which also forms here the closing element 4, takes place in this design by means of a pressure spring 46, which is arranged between the sleeve 40 and a pedestal part 12 of the centrifuge 1.

With the centrifuge rotor 2 arranged in the centrifuge 1 it ensures with its lower end that the sleeve 40 is held downwards against the pedestal part 12 against the force of the spring 46. The top of the sleeve 40 in this position opens the orifice openings 32 in the shaft 3. After reaching a minimum lubricating oil pressure the valve 33 also provided here moves into its open position and opens the flow path through the centrifuge 1.

If the centrifuge rotor 2 is missing, as is represented in FIG. 5*b*, the pressure spring 46 is able to lift the sleeve 4 off the pedestal part 12 upward until the sleeve 40 pushes with its upper front end against a stop 36, which is designed here as a retainer ring located on the shaft 3. In this position the sleeve 40 blocks the orifice openings 32 and therefore shuts off the bypass flow path for the lubricating oil. This blockage of the bypass flow is also maintained if the minimum pressure valve 33 changes into the open position.

FIGS. 6*a* and 6*b* of the drawing show a design of the centrifuge 1, for which it is typical that the lower bearing of the centrifuge rotor 2 is a shaft-fixed antifriction bearing 34' and that the shifting of the sleeve 40 forming the closing element 4 in a closing direction can be caused by the force of a spring 46. In the status in accordance with FIG. 6*a* with assembled centrifuge rotor 2, said centrifuge rotor presses the sleeve 40 by compressing the pressure spring 46 downwards into its lower final shift position, in which the sleeve 40 rests with its lower front end upon the pedestal part 12. The top of the sleeve 40 now opens the orifice openings 32. With open minimum pressure valve 33, the bypass flow path for the lubricating oil for the centrifuge 1 is opened.

FIG. 6*b* shows the status of the centrifuge 1 from FIG. 6*a* now again with a missing centrifuge rotor. In this status the pressure spring 46 lifts the sleeve 40 upward up to a stop 36 on the shaft 3. In this position the sleeve 40 again blocks the orifice openings 32, independently of whether the minimum pressure valve 33 is in the open position or in the closed position.

The shaft-fixed antifriction bearing 34' is located here again in the interior circumference of the sleeve 40 and shifts together with said sleeve in the axial direction of the shaft 3.

FIGS. 7*a*, 7*b* and 7*c* of the drawing show a design of the centrifuge 1, which exhibits in contrast to the designs previously described still another additional function, which is described as follows.

FIG. 7*a* shows first the centrifuge 1 with an assembled centrifuge rotor 2, which is also here mounted rotatable on the central housing-fixed shaft 3, here by means of rotor-fixed friction bearings 24. The shaft 3 is also here designed with a hollow inside 30. A closing element 4 in the form of an axially movable sleeve 40 is arranged in the lower part of the hollow inside 30 of the shaft 3. The lower end area of the shaft 3 is equipped with longitudinal slots 37. Through these longitudinal slots 37 extend one-pieced arms 47 in a radial direction outward from the sleeve 40. The shaft 3 is held with its lower end in a pedestal part 12 of the centrifuge 1, here by bolting.

A guide sleeve 50 is furthermore guided concentrically to the shaft 3 and axially movable in the upper central area of the pedestal part 12. This sleeve 50 is closed on its upper side. A helical compression spring 51 is supported at the bottom of this sleeve 50, which is closed on top, and at the top of the arms 47, which preloads the guide sleeve 50 and the arms 47 of the sleeve 40 with a force, which acts downwards on the sleeve 40 and upwards on the sleeve 50.

In the status with an assembled centrifuge rotor 2, shown in FIG. 7*a*, said centrifuge rotor presses with its lower friction bearing 24 on the top of the guide sleeve 50. Thereby the spring 51 is compressed and it presses in return, over the arms 47, the sleeve 40 downwards to its lower final shift position. The upper end area of the sleeve 40 is then situated in a position, in which it opens the orifice openings 32 from the hollow inside 30 of the shaft 3 into the inside of the centrifuge rotor 2.

As in the previously described design examples, a minimum pressure valve 33 is also provided in the area of the orifice opening 32, which is still in a closed position in the representation in accordance with FIG. 7*a*. As soon as a minimum lubricating oil pressure is reached in the hollow inside 30, the minimum pressure valve 33 moves into the open position and opens the flow path for the lubricating oil through the centrifuge 1 and its centrifuge rotor 2.

FIG. 7*b* shows the centrifuge 1 from FIG. 7*a* now in a status with a missing centrifuge rotor. Since now the centrifuge rotor 2 does not act upon the guide sleeve 50 anymore, a lubricating oil pressure present in the hollow inside 30 of the shaft 3 ensures now that the sleeve 40 is shifted together with the spring 51 and the guide sleeve 50 upward, until the sleeve 40 reaches its upper final shift position, as is shown in FIG. 7*b*. In this position the sleeve 40 blocks the orifice openings 32 with its top and prevents this way oil flow through the centrifuge 1. The minimum pressure valve 33 is shifted upward into its open position by the present lubricating oil pressure and by the sleeve 40; the sleeve 40 however blocks the orifice openings 32.

FIG. 7*c* shows now the previously mentioned additional function, which is provided with the centrifuge 1 in accordance with FIGS. 7*a*–7*c*. This additional function consists of the fact that with the centrifuge rotor 2 assembled in the centrifuge 1, the closing element 4 in the form of the movable sleeve 40 blocks the orifice openings 32, if a preset maximum lubricating oil pressure is reached or exceeded. In this case of a too high lubricating oil pressure, the hydraulic force of the lubricating oil acting upon the sleeve 4 ensures that the sleeve 40 is shifted upward against the force of the spring 51 into an upper final shift position, in which the sleeve 40 blocks the orifice openings 32. The movable guide sleeve 50 with this process retains its position unchanged, since it is inevitably localized in this position by the centrifuge rotor 2. The pressure spring 51 is compressed upward during the shifting of the sleeve 40. The upper limiting pressure, at which the sleeve 40 blocks the orifice openings 32, can be defined by the selection of the spring strength.

If the lubricating oil pressure drops again below the upper pressure limiting value, the force of the spring 51 exceeds the hydraulic force caused by the lubricating oil and working on the sleeve 40, so that the sleeve 40 is then moved again downwards and opens the orifice openings 32.

FIG. 8 shows an example of a centrifuge 1, in which the closing element 4 is again designed as an axially movable sleeve 40 on the inside 30 of the shaft 3. The sleeve 40 also exhibits in its lower area several radially outward protruding arms 47, which are guided in longitudinal slots 37 of the shaft 3. The shaft 3 is here held again in the pedestal part 12. An intermediate sleeve 13, which surrounds for its part the lower end of the shaft 3, is guided adjustably in the axial direction of the shaft 3.

At the bottom of the arms 47 a helical compression spring 46 supports itself, whose lower end is supported at a fixed area of the pedestal part 12, which is represented here only in a section. If the centrifuge rotor is missing, as represented in FIG. 8, the helical compression spring 46 is able to shift, via the arms 47, the sleeve 40 upward together with the intermediate sleeve 13 to their upper final shift position. In this final shift position the sleeve 40 blocks the orifice openings 32, so that an oil flow through the centrifuge 1 is prevented if the centrifuge rotor is missing.

Also here the minimum pressure valve 33 is shifted at the same time into its open position; this however has no effect, since the orifice openings 32 are blocked by the sleeve 40.

If a centrifuge rotor is assembled into the centrifuge 1 in accordance with FIG. 8, the centrifuge rotor presses the intermediate sleeve 13 downwards with its lower end, which is the reason why said sleeve is axially movable in the pedestal part 12 and on the outer circumference of the shaft 3 in a suitable guide. The lower end of the intermediate sleeve 13 presses on the arms 47 and thus moves the sleeve 40 downwards by compression of the pressure spring 46. In this status the sleeve 40 then opens the orifice openings 32 again. After reaching a minimum lubricating oil pressure and the opening of the minimum pressure valve 33 caused thereby, the oil flow path through the centrifuge is then free.

FIG. 9 of the drawing finally shows a design example of the centrifuge 1, which provides the same functions as the centrifuge 1 in accordance with FIGS. 7*a* to 7*c*. The representation of FIG. 9 corresponds thereby to the representation of FIG. 7*b*, thus shows the centrifuge 1 without an assembled centrifuge rotor.

The shaft 3 for the rotatable support of the centrifuge rotor is also here again firmly held in the pedestal part 12. A sleeve 40, which is axially movable in the hollow inside 30 of the lower part of the shaft 3, serves here again as a closing element 4. Also here the lower end area of the shaft 3 exhibits longitudinal slots 37, through which arms 47 of the sleeve 40 extend outward. A guide sleeve 50 is mounted on the outer circumference of the shaft 3 axially movable in its lower part, which is closed on its upper side and rests there tightly against the outer circumference of the shaft 3. Between the sleeve 50 and the top of the arms 47 of the sleeve 40 a helical compression spring 51 is arranged, which acts upon the guide sleeve 50 with a force pointing upward and upon the sleeve 40 with a force pointing downward. At the bottom of the arms 47 a second, weaker helical compression spring 46 supports itself, which rests with its other end against the pedestal part 12 of the centrifuge 1.

In the status without a centrifuge rotor, shown in FIG. 9, the lower helical compression spring 46 presses the sleeve 4 as well as thereby together the spring 51 and the guide sleeve 50 upward, until the sleeve 40 reaches its upper final shift position, in which it, as represented in FIG. 9, blocks the orifice openings 32. The minimum pressure valve 33 also provided here is then in its open position, however the blocking of the orifice openings 32 takes place independently of that via the sleeve 40 as the closing element 4.

If the centrifuge rotor is assembled into the centrifuge 1 in accordance with FIG. 9, the lower end of the rotor presses the guide sleeve 50 downwards. The stronger helical compression spring 51 thereby shifts the sleeve 40 over the arms 47 likewise downwards, whereby the weaker helical compression spring 46 is compressed. In this status the sleeve 40 opens the orifice openings 32. An oil flow through the centrifuge 1 is then opened, as soon as a minimum lubricating oil pressure is present to open the minimum pressure valve 33.

If the lubricating oil pressure in the hollow inside 30 of the shaft 3 rises above a preset upper pressure limiting value with assembled rotor, a hydraulic force acting upon the sleeve 40 results, which is directed upward. Since with assembled centrifuge rotor the guide sleeve 50 is defined in its lower position, the pressure spring 51 is compressed upward with the shift of the sleeve 40 by the hydraulic force of the lubricating oil if the lubricating oil pressure is accordingly high. If the sleeve 40 reaches its upper position, it blocks the orifice openings 32 and thus prevents the creation of a harmful excess pressure inside the centrifuge 1. If the lubricating oil pressure drops again below the preset upper limiting value, the coil spring 51 is able to shift the sleeve 40 again downwards against the now diminishing pressure of the lubricating oil and against the hydraulic force caused thereby. Thus the oil flow through the orifice openings 32 is opened again.

What is claimed is:

1. A centrifuge for the purification of lubricating oil of an internal-combustion engine, including a housing with a removable cover, housing-fixed shaft arranged in the housing and with a centrifuge rotor which is rotatably mounted on the shaft and is replaceable, whereby the shaft is hollow at least in its lower part and forms in its hollow inside a section of a lubricating oil supply canal, which canal is in flow connection with an inside of the centrifuge rotor mounted on the shaft over at least one orifice opening, comprising:

an adjustable valve plug arranged at the shaft and arranged to be held in an open position by the centrifuge rotor, the valve plug releasing the orifice opening in the open position, and the valve plug arranged to be transferred into a closing position and held in the closing positionby a force created by at least one of a pressure of the lubricating oil and by a preloading component of the centrifuge rotor is missing, the valve plug plugging the orifice opening in the closing position.

2. A centrifuge according to claim 1, wherein a sleeve, which is adjustable in a longitudinal direction of the shaft, is arranged as a valve plug and the orifice opening is a lateral opening from the hollow inside of the shaft outward.

3. A centrifuge according to claim 2, wherein said sleeve is arranged in the hollow inside of the shaft.

4. A centrifuge according to claim 3, wherein the sleeve includes arms running radially from the inside outward, which are situated in longitudinal slots of the lower end area of the shaft and which guide the sleeve secured against torsion.

5. A centrifuge according to claim 2, wherein said sleeve is arranged on an outer circumference of the shaft.

6. A centrifuge according to claim 5, wherein the sleeve includes arms running radially from the outside inward, which are situated in longitudinal slots of the lower end area of the shaft and which guide the sleeve secured against torsion.

7. A centrifuge according to claim 5, wherein a lower end piece of the shaft itself or a shaft pedestal supporting the shaft includes an increased outside diameter in relation to the remaining shaft and the sleeve fits to the increased outside diameter with a stepped interior with a larger diameter in its lower part and with a smaller diameter in its upper part.

8. A centrifuge according to claim 7, wherein the shaft further includes a lateral opening from its hollow inside outward at a height of the larger inside diameter of the sleeve and the sleeve is sealed in its lower end area at its interior diameter against the outer circumference of the shaft or the shaft pedestal by means of a slide seal.

9. A centrifuge according to claim 2, wherein between the sleeve and a pedestal part of the housing at least one pressure spring is arranged as the preloading component.

10. A centrifuge according to claim 2, wherein a lower pivot bearing of the centrifuge rotor is designed as a shaft-fixed antifriction bearing.

11. A centrifuge according to claim 10, wherein the antifriction bearing is arranged at the interior circumference of the sleeve and together the antifriction bearing and the sleeve are axially adjustable on the shaft.

12. A centrifuge according claim 10, wherein a pedestal part of the housing supporting the shaft limits a shift path of the sleeve in its opening direction.

13. A centrifuge according to claim 10, wherein the shaft includes a stop to limit a shift path of the sleeve in its closing direction.

14. A centrifuge according to claim 1, wherein a lower pivot bearing of the centrifuge rotor is designed as a rotor-fixed friction bearing.

15. A centrifuge according to claim 1, wherein a lower pivot bearing of the centrifuge rotor is designed as a shaft-fixed friction bearing.

16. A centrifuge according to claim 1, wherein a valve is integrated into the shaft, which valve releases a supply of lubricating oil to the centrifuge rotor only when achieving a preset minimum lubricating oil pressure.

17. A centrifuge according to claim 1, wherein with the centrifuge rotor inserted into the housing the valve plug is adjustable in the closing direction against a preloading force working in its opening direction by a force which is created by a lubricating oil pressure above a preset upper lubricating oil limiting pressure.

18. A centrifuge according to claim 17, wherein at least one spring is provided between the bottom of the centrifuge rotor and the valve plug, the spring preloading the valve plug with a force directed in its opening direction and the valve plug is adjustable in the closing direction against the force of the spring which is created by a force of the upper lubricating oil limiting pressure.

19. A centrifuge according to claim 18, wherein a guide sleeve, which is adjustable coaxially relative to the shaft, is arranged between the bottom of the centrifuge rotor and the spring, which is, if the centrifuge rotor is inserted, held in a lower final shift position by said centrifuge rotor and which assumes an upper final shift position, if the centrifuge rotor is not present, due to a lubricating oil pressure force or a spring force.

* * * * *